United States Patent [19]

Lundstrom et al.

[11] B 3,981,368

[45] Sept. 21, 1976

[54] COUPLING MEANS IN A DRILLING MACHINE

[75] Inventors: Hans Per Olof Lundstrom; Ernst Lennart Johansson, both of Sandviken, Sweden

[73] Assignee: Sandvik Aktiebolag, Sandviken, Sweden

[22] Filed: Dec. 31, 1974

[21] Appl. No.: 537,709

[44] Published under the second Trial Voluntary Protest Program on January 13, 1976 as document No. B 537,709.

[52] U.S. Cl. ..... 173/104; 175/173

[51] Int. Cl.[2] ..... B25D 9/00

[58] Field of Search ..... 173/104; 175/173, 171

[56] References Cited

UNITED STATES PATENTS

| | | | |
|---|---|---|---|
| 1,203,860 | 11/1916 | Dunbar | 175/173 |
| 1,869,892 | 8/1932 | Grove et al. | 175/173 |
| 3,416,615 | 12/1968 | Grospas | 175/173 |

FOREIGN PATENTS OR APPLICATIONS

| | | | |
|---|---|---|---|
| 959,955 | 6/1964 | United Kingdom | 175/173 |

*Primary Examiner*—James A. Leppink

*Attorney, Agent, or Firm*—Pierce, Scheffler & Parker

[57] ABSTRACT

A drilling machine may include extension equipment comprising (a) drill rods — connected end-to-end — for transmission of impact force and (b) a system of tubular members — likewise connected end-to-end — surrounding said rods, for transmission of rotary force. Such extension equipment may be coupled to the machine per se by means of a tubular adapter threadably connected, at one of its ends, to the tubular members system and at its opposite end connected to the machine through polygonal coupling means.

5 Claims, 3 Drawing Figures

COUPLING MEANS IN A DRILLING MACHINE

This invention relates to coupling means in a drilling machine for connecting extension equipment to said machine, said extension equipment comprising a plurality of rods which can be mounted in end-to-end relation, and a plurality of tubes -- adapted to be connected together end-to-end -- disposed concentrically around said rod members.

Extension drill steel equipment for a percussive type of drilling machine normally comprises a shank adapter, coupling sleeves, extension rods and a bit. These components are joined together with screw threads. There are, however, several disadvantages associated with such drill steel equipment adapted to transmit both impact and rotary forces therethrough. For example, tests have shown that with these coupling sleeves there is a considerable loss of energy in transmitting an impact force through such a drill steel. Due to said coupling sleeves the drill steel unit will be unequal in diameter throughout its length which inequality impairs its shock wave transmission capacity. This rod structure also is detrimental to the effective blowing of drill cuttings back along the exterior of said rods. Since the threads have to transmit the shock waves of the drill from the shank adapter to the bit they are subjected to severe stresses, which make heavy demands on their strength, wear resistance and transmission capacity. It is also necessary that the connections be easy to connect and to dismantle.

In the light of the above facts it is an object of the invention to provide new coupling means which make it possible to connect an extension equipment of the aforementioned type to a drilling machine, the central rods whereof forming a line adapted for impact force transmission from the drilling machine at one end of the line to drill bit secured at the opposite end of the line, and the system of tubular members being adapted for the transmission of rotary force from the drilling machine to the drill bit.

To this end there is provided coupling means comprising a tubular adapter by means of which the extension equipment is capable of being elastically connected to the drilling machine, the lowermost section of said tubular adapter being connected to the tubular system of said equipment while its upper end section is provided with coupling means, preferably splines, to mate with a corresponding coupling member of the drilling machine.

Figure 1:
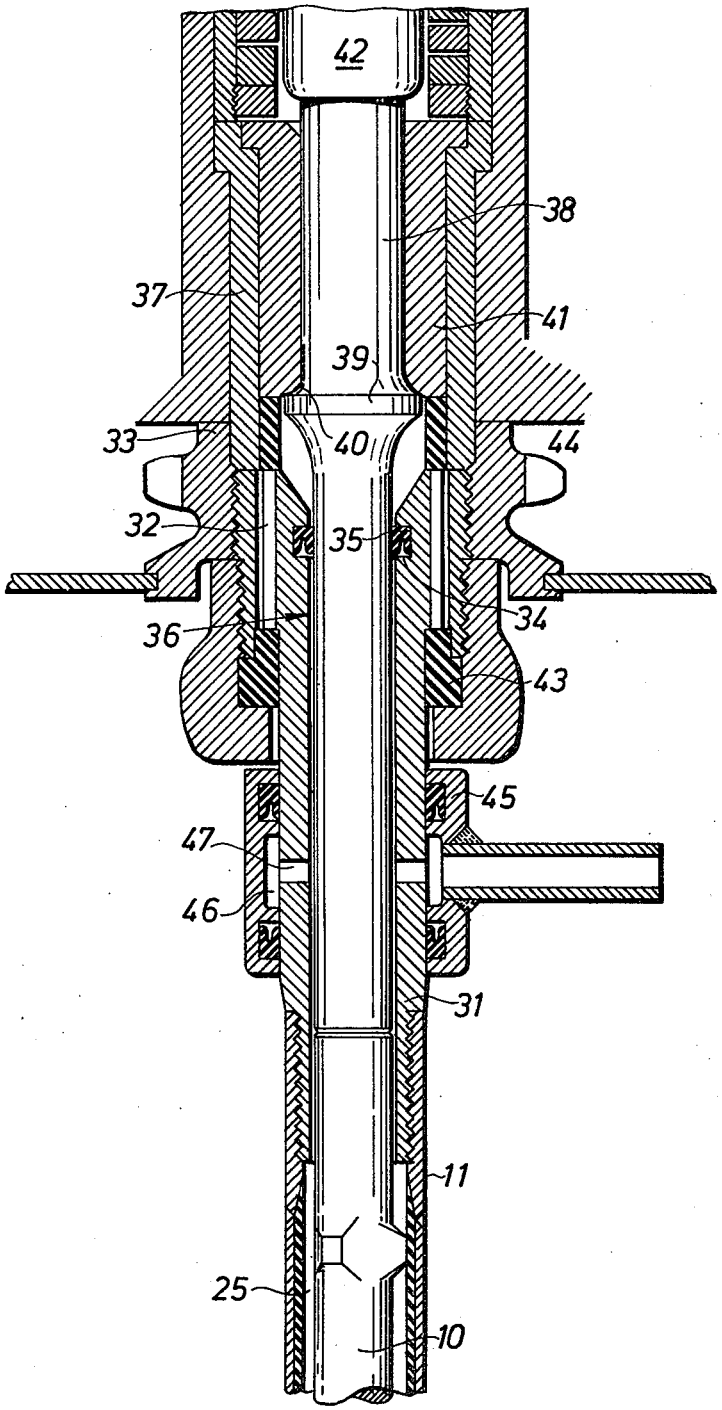
Figure 2:
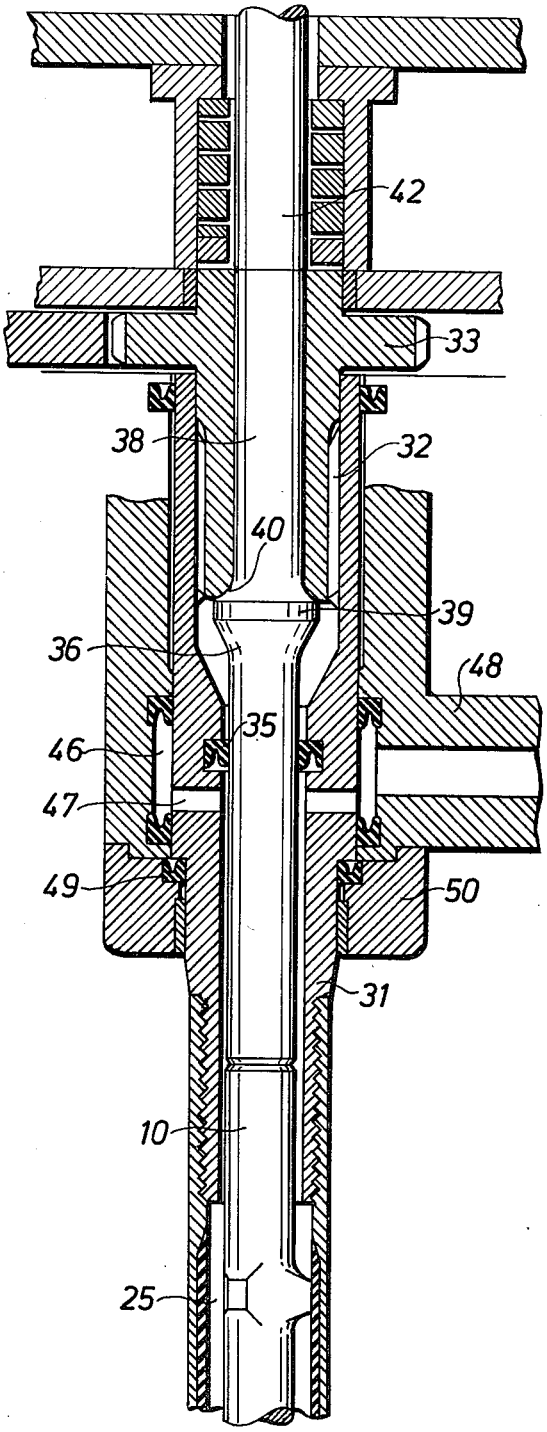
Figure 3:
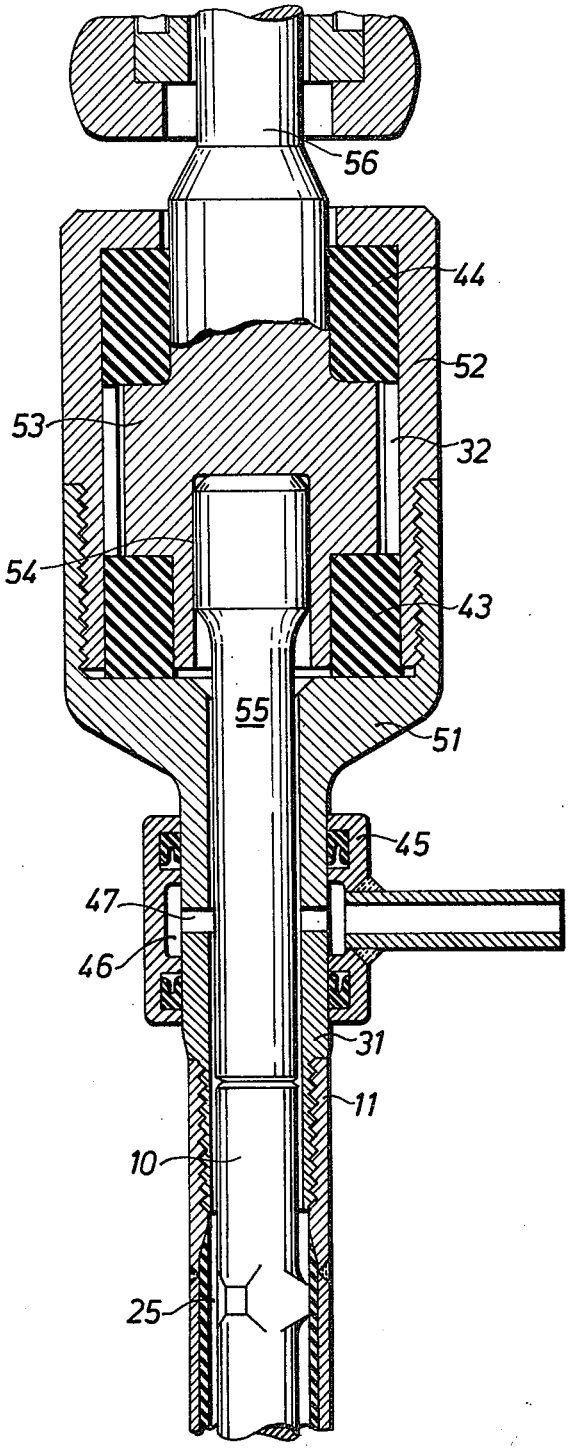

Preferred embodiments of the invention will now be described in detail and with reference to the accompanying drawings, in which:

FIG. 1 is a longitudinal sectional elevation showing one embodiment of the invention; and FIGS. 2 and 3 are longitudinal sectional elevational views showing alternative embodiments of the invention. instance,- may Referring to FIG. 1, the coupling means according to the invention comprises a tubular adapter 31 the lowermost end section of which is exteriorly threaded for connection to the tubes 11 of an extension equipment, the inner rod members of the latter having reference numeral 10. The upper end section of said adapter 31 is exteriorly splined at 32 for connection to a correspondingly splined coupling member 33 in the drilling machine for the transmission of rotary movement to the equipment. It is to be understood, however, that also otherwise polygonally shaped coupling means,- hexagonal shape for instance,-may be employed for the transmission of said rotary movement.

Adapter 31 is associated with an annular sealing ring 35 which is received in an annular groove 34 concentrically enclosing a rod-shaped impact force-transmitting member 36, said rod member 36 suitably being configured similarly to drill rod member 10. Due to the arrangement of said annular sealing ring 35, flushing medium is prevented from penetrating into the drilling machine, an axial guidance of said rod member 36 simultaneously being obtained. A collet 37 is connected to a driving gear acting as coupling member 33. The driving gear 33 is capable of being rotated by conventional means so that rotary movement is transmitted to drill tubes 11 and to a drill bit (not shown) secured at the opposite end of said tubes.

The neck portion 38 of impact-transmitting rod 36 is centrally located within the collect 37, a radially extending collar 39 of said rod being adapted for abutment against a corresponding abutment surface 40 on a bushing 41 received in the collect 37 for transmission of feeding pressure from the drilling machine to the drill rod. Impact force is transmitted from hammer piston 42 to rod member 36.

Inserts or bushings 43 and 44 of rubber or similar material may be provided on both sides of said splined connection which in association with such connection renders the extension equipment elastically connected to the drilling machine while also attaining a certain noise-suppressing effect therewith. With this embodiment a separate flushing head 45 is provided for the transmission of flushing medium into the space 25 between rods and tubrs of said equipment via an annular channel 46 and radially extending channels 47 in the tubular adapter 31.

In FIG. 2 there is shown an alternative embodiment of the coupling means according to the invention, in which showing parts corresponding with those in said first embodiment have the the same reference numerals. As appears therefrom, the driving gear 33 is now directly connected to the tubular members 31 via the splined connection 32. Flushing medium is transmitted directly into the adapter assembly via a member 48. For the purpose of preventing member 31 from falling out the latter is provided with a shoulder abutment 49 that is axially opposed to a correspondingly shouldered front casing 50 of the drilling machine. As for the rest, this embodiment is principally constructed similarly to the embodiment shown in FIG. 1.

Another embodiment of the invention is shown in FIG. 3, the tubular adapter 31 there being connected to the drilling machine in a somewhat different manner. Thus, adapter 31 can be considered as consisting of two parts, the lowermost 51 of which being exteriorly threaded as before and connected to drill tube 11, whereas the upper portion thereof is connected to another part 52 of the adapter via a threaded connection said latter part being interiorly splined at 32 for connection to a correspondingly splined member 53. The latter is provided with a central bore 54 for the partial reception of an impact force-transmitting rod 55. Rod 55 axially abutts against the uppermost rod member 10 of the rod system. Member 53 is, in turn, received in the drilling machine at a constricted neck portion 56, said portion being mounted in end-to-end relation with a hammer piston (not shown). Vulcanized rubber inserts 43 and 44 are provided on opposite sides of the splined connection 32, as shown in FIG. 1.

The above related embodiment of FIG. 3 is of advantage because it enables extension equipment of the aforementioned type to be connected to drilling machines of conventional design without reconstruction thereof. The only measure needed is to exchange the conventional shank adapter for the impact-transmitting member 53, the uppermost end of which is received in the drilling machine whereas the lowermost end thereof is to be received in an additional adapter assembly in which impact force and rotary movement is transmitted to said equipment as shown in FIG. 3.

In the embodiments described, extension equipment is elastically connected to the drilling machine because of the splined connection. This enables the equipment to take angular positions relative to the drilling machine. The inserts of rubber or equivalent provided on opposite sides of said connection also contribute thereto. Such elastic connection is of advantage at long hole drilling and when using equipment of large dimensions as stiffness of its members will otherwise unfavorably affect wear of said connection. The noise-suppressing effect is also improved because the splined connection gives rise to friction and thus a certain energy destruction.

We claim:

1. A rock drilling equipment of the character having an impact and rotary force-transmitting device for use with a percussive type drill motor having a reciprocal piston delivering percussive force, said equipment comprising:

a rotatable tube (11), said tube being composed of a plurality of sections connected in end to end relation, one end section of which is connected to said drill motor and the other end section being connected to a drill bit;

a rod (10) being in sections connected in end to end relation, said rod being slidable within said tube, one end of said rod having a force-receiving surface and the other end having a force-transmitting surface to transmit only longitudinal forces to said bit;

a tubular adapter (31) in interlocking connection with said tube, the uppermost part of said adapter being received in a tubular casing and enclosing an uppermost rod section (36), the latter being adapted to transmit percussion force from said reciprocal piston (42) to said drill bit, said adapter being provided with longitudinally extending connection means (32) around its circumference; and a coupling member (33), rotatable by said drill motor, said coupling member being provided with corresponding connection means to mate circumferentially with said adapter within said casing for transmitting only rotary motion to said tube and said bit, said mating being effected with clearance such that said tube is able to take angular positions relative to said casing.

2. Coupling means according to claim 1, wherein inserts (43, 44) of elastic material are provided on opposite sides of the rotary force-transmitting connection means (32).

3. Coupling means according to claim 1, wherein inserts (43, 44) of rubber are provided on opposite sides of the rotary force-transmitting connection means (32).

4. Coupling means according to claim 1, wherein the tubular adapter (31) and the coupling member (33) connected thereto enclose a rod-shaped impact force-transmitting member (36) which is provided with a radially extending collar (39) adapted for abutment against a correspondingly shaped abutment surface on the coupling member (33) for the transmission of feeding pressure from the drilling machine.

5. Rock drilling equipment as defined in claim 1, wherein the tubular adapter (31) is splined at its upper end section for connection with corresponding splines on said coupling member.

* * * * *